US007270094B2

(12) United States Patent
Mashiki et al.

(10) Patent No.: US 7,270,094 B2
(45) Date of Patent: Sep. 18, 2007

(54) CONTROL APPARATUS FOR ELECTRIC VARIABLE VALVE ACTUATION MECHANISM

(75) Inventors: Zenichiro Mashiki, Nisshin (JP); Haruyuki Urushihata, Chiryu (JP)

(73) Assignees: Toyota Jidosha Kabushiki Kaisha, Toyota (JP); Denso Corporation, Kariya (JP)

( * ) Notice: Subject to any disclaimer, the term of this patent is extended or adjusted under 35 U.S.C. 154(b) by 0 days.

(21) Appl. No.: 11/376,318

(22) Filed: Mar. 16, 2006

(65) Prior Publication Data

US 2006/0207531 A1 Sep. 21, 2006

(30) Foreign Application Priority Data

Mar. 17, 2005 (JP) ..... 2005-077494

(51) Int. Cl.
*F01L 9/04* (2006.01)

(52) U.S. Cl. ..... 123/90.11; 123/90.15; 123/179.3; 123/347

(58) Field of Classification Search ..... 123/90.11, 123/90.15, 90.17, 179.3, 179.4, 179.18, 347, 123/348; 701/113; 251/129.01
See application file for complete search history.

(56) References Cited

U.S. PATENT DOCUMENTS 7,096,841 B2 * 8/2006 Hattori et al. ..... 123/182.1

FOREIGN PATENT DOCUMENTS

| | | |
|---|---|---|
| DE | 197 36 137 C1 | 10/1998 |
| JP | B2-2917067 | 4/1999 |
| JP | A-2004-150397 | 5/2004 |

* cited by examiner

*Primary Examiner*—Ching Chang
(74) *Attorney, Agent, or Firm*—Oliff & Berridge, PLC

(57) ABSTRACT

An electric variable valve timing mechanism and a starter are actuated by electricity supplied from a common battery. During an engine starting process, the starter is actuated, and an electronic control unit controls the electric variable valve timing mechanism. The electronic control unit limits the actuation of the electric variable valve timing mechanism on the condition that, during the engine starting process, the voltage value of the battery falls below a predetermined threshold value that degrades the operation of the starter. As a result, the engine is started in a stable manner.

15 Claims, 4 Drawing Sheets

CONTROL APPARATUS FOR ELECTRIC VARIABLE VALVE ACTUATION MECHANISM

BACKGROUND OF THE INVENTION

The present invention relates to a control apparatus for an electric variable valve actuation mechanism that adjusts valve actuation of either or both of an intake valve and an exhaust valve in an internal combustion engine.

For example, Japanese Laid-Open Patent Publication No. 2004-150397 discloses an electric variable valve actuation mechanism that adjusts the valve actuation of either or both of an intake valve and an exhaust valve in an internal combustion engine. The mechanism uses an electric motor as a drive source. Such an electric variable valve actuation mechanism normally eliminates the period during which the intake valve and the exhaust valve are both open, or valve overlap, in the engine starting process, thereby limiting backflow of exhaust gas discharged from the combustion chamber to the combustion chamber or the intake port.

In recent years, in order to improve the combustion performance during the engine starting process, a configuration has been adopted in which, instead of completely eliminating the valve overlap, the opening timing of the intake valve is slightly advanced to control the valve overlap during the engine starting process.

As shown in FIG. 6, an electric motor 22 of an electric variable valve actuation mechanism 2 as described above shares a battery 40 (power source) with a starter motor 32 of a starter 30 (starting device) and an electronic control unit 1. Reference numeral 34 represents an ignition switch. Therefore, when controlling the valve overlap during the engine starting process, electricity from the battery 40 must be supplied to an electric variable valve actuation mechanism 2 as a matter of course. However, the supply of electricity from the power source 40 to the electric variable valve actuation mechanism 2 during the engine starting process results in insufficient supply of electricity to the starter 30, which can reduce the driving force of the starter 30. That is, in this case, while advantage of an improved combustion performance is obtained by controlling the valve overlap during the engine starting process, there is a drawback in that the supply of electricity to the electric variable valve actuation mechanism 2 reduces the driving force of the starter 30, and that the starting performance of the engine is reduced. If such drawback related to the reduced starting performance outweighs the advantage of the improved combustion performance, the activation of the mechanism 2 can degrade the starting performance of the engine.

SUMMARY OF THE INVENTION

Accordingly, it is an objective of the present invention to provide a control apparatus for an electric variable valve actuation mechanism that permits an engine to start in a stable manner.

To achieve the foregoing objective, the present invention provides a control apparatus for an electric variable valve actuation mechanism in an internal combustion engine. The electric variable valve actuation mechanism is actuated by electricity supplied from a common power source shared with a starting device of the engine to adjust valve timing of at least one of an intake valve and an exhaust valve of the engine. During a process for starting the engine, the starting device is actuated and the control apparatus controls the electric variable valve actuation mechanism. The control apparatus limits the actuation of the electric variable valve actuation mechanism on the condition that, during the engine starting process, the voltage value of the power source falls below a predetermined threshold value that degrades the operation of the starting device.

The present invention provides another control apparatus for an electric variable valve actuation mechanism in an internal combustion engine. The electric variable valve actuation mechanism is actuated by electricity supplied from a common power source shared with a starting device of the engine to adjust valve timing of at least one of an intake valve and an exhaust valve of the engine. During a process for starting the engine, the starting device is actuated and the control apparatus controls the electric variable valve actuation mechanism. The control apparatus limits the actuation of the electric variable valve actuation mechanism on the condition that the voltage value of the power source at the initiation of the engine starting process is below a predetermined threshold value, below which the voltage value is predicted to be lowered to a level that degrades the operation of the starting device during the engine starting process.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A control apparatus for an electric variable valve actuation mechanism according to a first embodiment of the present invention will now be described with reference to FIGS. 1 to 3. In this embodiment, an electric variable valve actuation mechanism is exemplified by a variable valve timing mechanism 20 that adjusts opening and closing timing of an intake valve 61 of an internal combustion engine as shown in FIG. 1.

Figure 1:
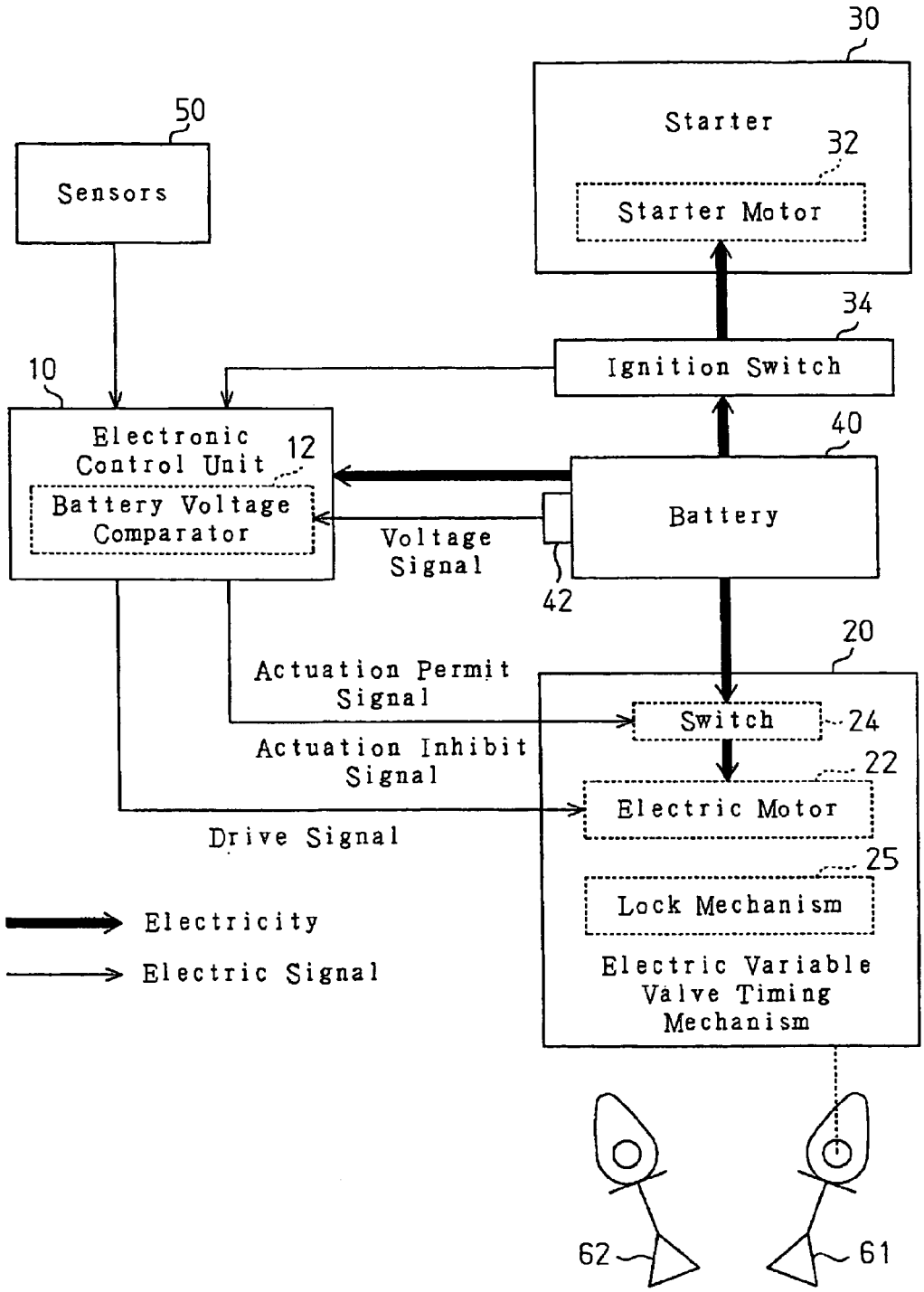
FIG. 1 is a block diagram illustrating an electric configuration of a control apparatus for an electric variable valve actuation mechanism and peripheral devices.

FIG. 1 illustrates an electronic control unit 10, which functions as a control apparatus for an electric variable valve actuation mechanism according to the present invention, the electric variable valve timing mechanism 20, a starter 30 (starting device), and a battery 40 (power source). A lead storage battery, the maximum voltage of which is 14V, is used as the battery 40.

The starter 30 includes a starter motor 32. During the engine starting process, the starter 30 receives electricity from the battery 40 to generate driving force to rotate a crankshaft, which is an output shaft of the engine. When a driver attempts to start the engine, the driver turns on an ignition switch 34 provided in the vicinity of the river's seat, so that electricity is supplied from the battery 40 to the starter 30.

The electronic control unit 10, which is a controller or a computer, is activated by electricity supplied by the battery 40 and controls various devices such as the electric variable valve timing mechanism 20 based on signals indicating the engine operating state sent from various sensors 50. The electronic control unit 10 has in it a battery voltage comparator 12 as shown in FIG. 1. Based on a voltage signal from a voltage detector 42, the battery voltage comparator 12 compares a voltage Va of the battery during the engine starting process with a threshold value Ve. Then, according to the result of the comparison, the voltage comparator 12 sends either an actuation permit signal or an actuation inhibit signal to the electric variable valve timing mechanism 20.

The electric variable valve timing mechanism 20 includes an electric motor 22 that is driven by electricity supplied by the battery 40 and a switch 24. In response to a drive signal sent from the electronic control unit 10 during the engine starting process, the electric motor 22 advances or retards the rotational phase of an intake camshaft for opening and closing the intake valve 61 with respect to the rotational phase of the crankshaft, thereby advancing or retarding the opening and closing timing of the intake valve 61. The switch 24 receives either one of the actuation permit signal or the actuation inhibit signal from the electronic control unit 10, and switches between a state for supplying electricity from the battery 40 to the electric motor 22 and a state for stopping the supply of electricity. In this embodiment, when the engine starting process is initiated, an actuation permit signal is sent to the electric variable valve timing mechanism 20 in an initial state, When an actuation inhibit signal is sent from the electronic control unit 10 to the switch 24, that is, when the supply of electricity from the battery 40 to the electric variable valve timing mechanism 20 is stopped, a lock mechanism 25 of the mechanism 20 maintains the opening and closing timing of the intake valve 61 to a timing that minimizes the valve overlap, during which the intake and exhaust valves 61, 62 are both open.

Hereinafter, a procedure for determining whether to continue actuating the electric variable valve timing mechanism (VVT) 20 during the engine starting process or to inhibit the actuation of the mechanism 20 will be described with reference to the flowchart of FIG. 2. A series of processes in the flowchart is repeatedly executed at predetermined time intervals during the engine starting process executed by the electronic control unit 10, that is, during a period from when the engine starting process is initiated to when the complete combustion is started and actuation of the starter 30 is stopped.

Figure 2:
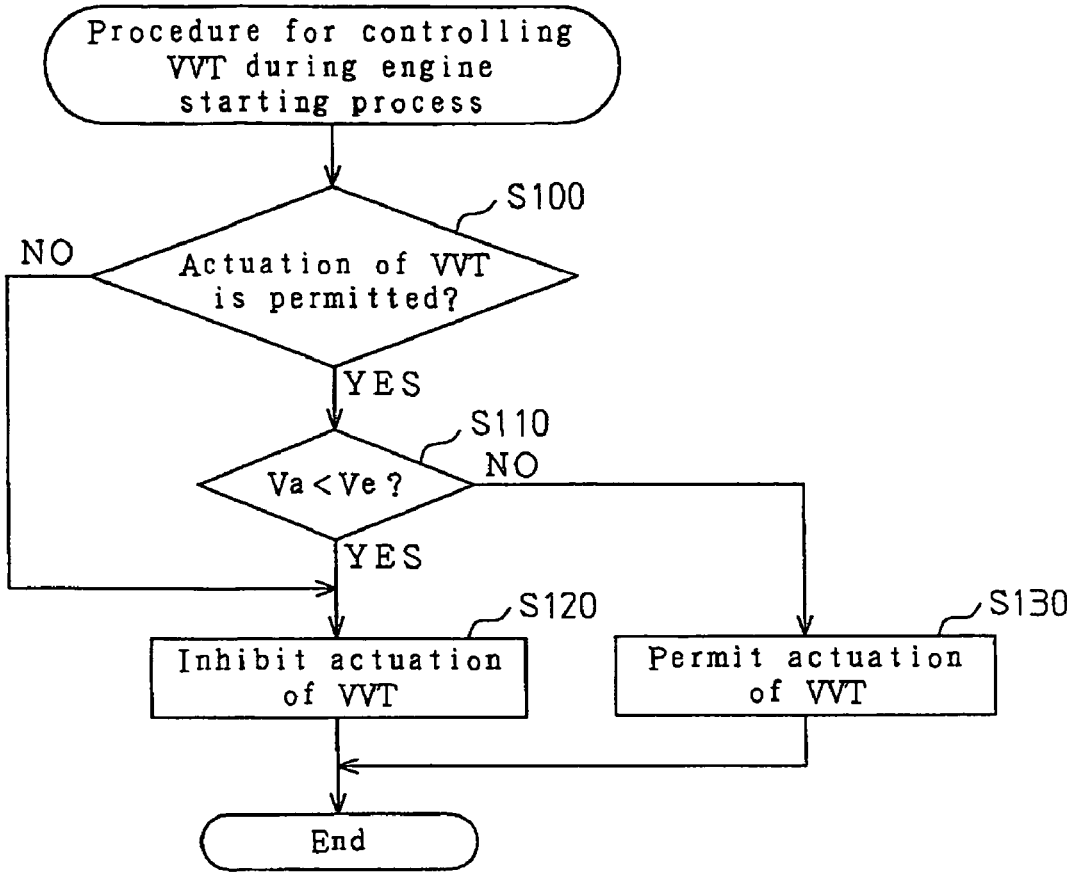
FIG. 2 is a flowchart showing a procedure of control executed by the control apparatus shown in FIG. 1.

In the procedure shown in FIG. 2, whether the actuation of the electric variable valve timing mechanism (VVT) 20 is permitted is determined (step 100). In the initial state, an actuation permit signal is sent to the electric variable valve timing mechanism 20 when the engine starting process is initiated. That is, the switch 24 is turned on, and electricity is supplied from battery 40 to the electric motor 22. Thus, the outcome of step 100 is always YES in the initial process, and the process proceeds to step 110. From the next execution of the control onward, the actuation state of the electric variable valve timing mechanism 20 is determined at step 100.

If the actuation is determined to be permitted through the determination of step 100 (YES at step 100), whether the current voltage Va of the battery 40 is less than the predetermined threshold value Ve is determined (step 110). The threshold value Ve is a value of voltage for determining whether to continue actuating the electric variable valve timing mechanism 20. In this embodiment, the threshold value Ve is an operation ensuring voltage Ve (for example, 8V) that can ensure the normal operation of the electronic control unit 10.

If the voltage Va of the battery 40 is determined to be less than the operation ensuring voltage Ve (YES at step 110), the actuation of the electric variable valve timing mechanism 20 is inhibited (step 120). Specifically, the electronic control unit 10 sends an actuation inhibit signal to the switch 24 to turn off the switch 24, which stops the supply of electricity from the battery 40 to the electric variable valve timing mechanism 20. After the actuation of the electric variable valve timing mechanism 20 is inhibited in this manner based on the fact that the voltage Va of the battery 40 is less than the threshold value Ve, the procedure is temporarily suspended. Once the actuation of the electric variable valve timing mechanism 20 is inhibited, the actuation of the mechanism 20 continues being inhibited until the engine starting process is completed.

On the other hand, if the voltage Va of the battery 40 is determined not to be less than the operation ensuring voltage Ve (NO at step 110), the actuation of the electric variable valve timing mechanism 20 is permitted (step 130). Specifically, the electronic control unit 10 sends an actuation permit signal to the switch 24 so that the switch 24 remains turned on, which continues the supply of electricity from the battery 40 to the electric variable valve timing mechanism 20. After the actuation of the electric variable valve timing mechanism 20 is permitted in this manner based on the fact that the voltage Va of the battery 40 is equal to or higher than the threshold value Ve, the procedure is temporarily suspended.

Changes in the battery voltage based on control of the electric variable valve timing mechanism 20 as described above will now be described with reference to FIG. 3 in comparison with the prior art.

Figure 3:
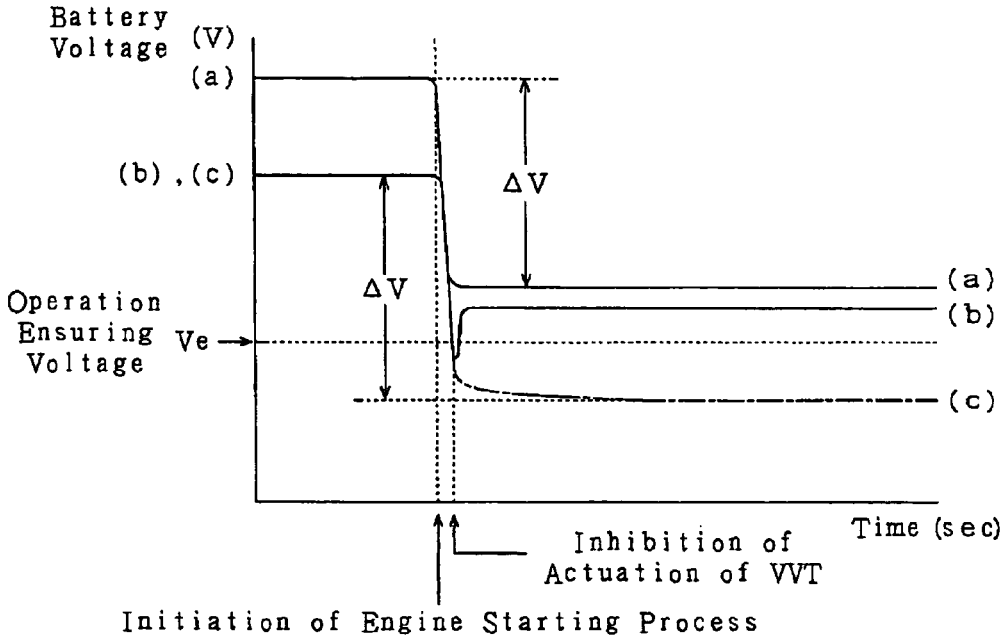
FIG. 3 is a time chart showing changes in battery voltage over time.

FIG. 3 shows changes in the voltage of the battery 40 over time during the engine starting process. Solid line (a) represents changes in the voltage Va of the battery 40 in a state where the voltage Va is sufficiently high before initiating the engine starting process and does not fall below the threshold value Ve during the engine starting process. Solid line (b) represents changes in the voltage Va of the battery 40 during the control of the electric variable valve timing mechanism 20 of this embodiment in a state where the voltage Va is relatively low before initiating the engine starting process. Alternate long and short dash line (c) represents changes in the voltage Va of the battery 40 during the control of the electric variable valve timing mechanism 20 of the prior art in a state where the voltage Va is relatively low before initiating the engine starting process.

When electricity is supplied from the battery 40 to the starter 30 and the engine starting process is initiated, the voltage V a of the battery 40 is lowered by the amount $\Delta V$ as shown in FIG. 3 due to the supply of electricity to devices such as the starter 30 and the electric variable valve timing mechanism 20. If the voltage Va of the battery 40 is sufficiently high before initiating the engine starting process, the voltage Va remains higher than the threshold value Ve after dropping in the above shown manner (see solid line (a) in FIG. 3). Therefore, sufficient electricity is supplied to the starter 30 and the electronic control unit 10 while actuating the electric variable valve timing mechanism 20. The actuation of these devices are thus prevented from being unstable.

On the other hand, when the voltage Va of the battery 40 is low before initiating the engine starting process, the voltage Va falls below the threshold value Ve due to the supply of electricity used in the engine starting process. In the prior art (see long and short dash line (c) in FIG. 3), the electric variable valve timing mechanism 20 continues being actuated in this state. Sufficient electricity therefore cannot be supplied to the electronic control unit 10 and the starter 30.

In contrast, the supply of electricity to the electric variable valve timing mechanism 20 is stopped on the condition that the voltage Va of the battery 40 is less than the threshold value Ve in this embodiment (see solid line (b) in FIG. 3). Thus, although the voltage Va of the battery 40 temporarily falls below the threshold value Ve, the voltage Va surpasses the threshold value Ve immediately thereafter. Accordingly, sufficient electricity is supplied to the starter 30 and the electronic control unit 10 again.

The above illustrated embodiment provides the following advantages.

(1) The actuation of the electric variable valve timing mechanism 20 is inhibited on the condition that the voltage Va of the battery 40 falls below the voltage Ve, which ensures the operation of the electronic control unit 10, during the engine starting process. Therefore, by stopping the supply of electricity to the electric variable valve timing mechanism 20, a great amount of electricity is supplied to devices such as the electronic control unit 10 and the starter 30. Thus, not only the starter 30 is actuated, but also the operation of the electronic control unit 10, which is actuated by electricity supplied from the battery 40, is ensured. The engine is thus stably started.

(2) The electronic control unit 10 realizes limitation of the actuation of the electric variable valve timing mechanism 20 by inhibiting the actuation of the mechanism 20. Therefore, the engine starting process is stabilized by a simple control.

(3) If the valve overlap, during which the intake valve 61 and the exhaust valve 62 are both open, is extended during the engine starting process during which the engine speed is low, exhaust gas that has been discharged from the combustion chamber flows back to the combustion chamber and to the intake port. This degrades the combustion performance. Therefore, if the actuation of the electric variable valve timing mechanism 20 is inhibited and the valve overlap is increased, the combustion performance can deteriorate. In this respect, according to the present embodiment, the valve overlap is held to be the minimum even when electricity is not supplied to the electric variable valve timing mechanism 20 from the battery 40. As a result, even in a case where the actuation of the electric variable valve timing mechanism 20 is inhibited, the combustion performance is prevented from deteriorating.

A control apparatus for an electric variable valve actuation mechanism according to a second embodiment of the present invention will now be described with reference to FIGS. 4 and 5. The second embodiment is different from the first embodiment in that, when initiating the engine starting process, whether the voltage Va of the battery 40 will fall below the threshold value Ve during the engine starting process is predicted, and whether to actuate the electric variable valve actuation mechanism is determined (prediction whether the battery voltage Va will fall below the threshold value Ve during the engine starting process and determination whether to actuate the electric variable valve actuation mechanism are executed when initiating the engine starting process). The control apparatus for the electric variable valve actuation mechanism has the same configuration as that of the first embodiment shown in FIG. 1. The differences from the first embodiment will mainly be discussed below.

Figure 4:
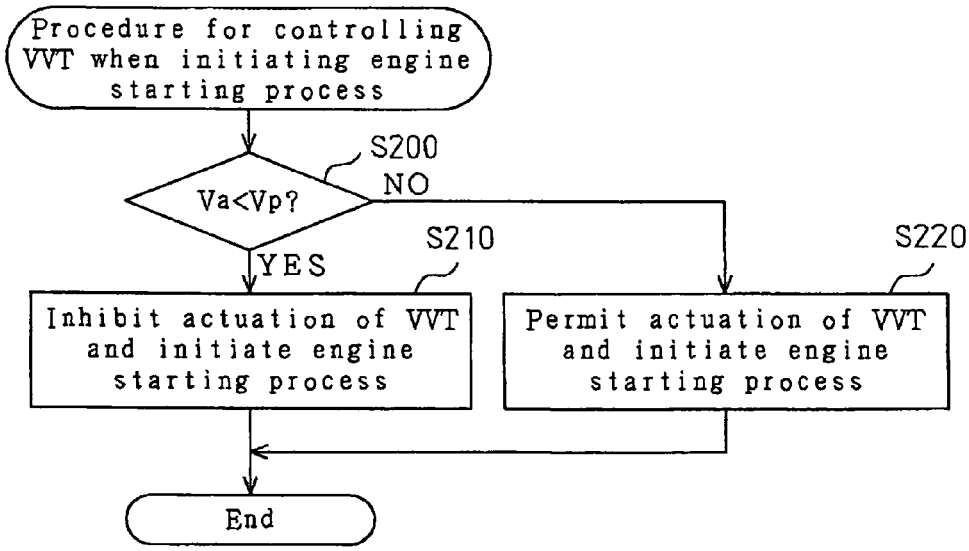
FIG. 4 is a flowchart showing a procedure of control according to a modified embodiment the present invention.

As shown in FIG. 4, it is determined whether the current voltage Va of the battery 40 when initiating the engine starting process is less than a threshold value Vp, which is discussed below (step 100). The threshold value Vp is a value of voltage for determining whether to actuate the electric variable valve timing mechanism 20 when initiating the engine starting process. In this embodiment, the threshold value Vp is obtained by adding an amount of decrease ΔV of the voltage Va of the battery 40 that is predicted to be caused due to the engine starting process to the operation ensuring voltage Ve for the electronic control unit 10 ($Vp=Ve+\Delta V$) as shown in FIG. 5.

If the voltage Va of the battery 40 is determined to be less than the threshold value Vp (YES at step 200), the actuation of the electric variable valve timing mechanism 20 is inhibited and the engine starting process is initiated (step 210). Specifically, the electronic control unit 10 sends an actuation inhibit signal to the switch 24 to turn off the switch 24, which stops the supply of electricity from the battery 40 to the electric variable valve timing mechanism 20. As in the first embodiment, the valve overlap is held to be the minimum. After the actuation of the electric variable valve timing mechanism 20 is inhibited in this manner based on the fact that the voltage Va of the battery 40 is less than the threshold value Vp, the procedure is terminated.

On the other hand, if the voltage Va of the battery 40 is determined not to be less than the threshold value Vp (NO at step 200), the actuation of the electric variable valve timing mechanism 20 is permitted and the engine starting process is initiated (step 220). Specifically, the electronic control unit 10 sends an actuation permit signal to the switch 24 to turn on the switch 24, which supplies electricity from the battery 40 to the electric variable valve timing mechanism 20. After the actuation of the electric variable valve timing mechanism 20 is permitted in this manner based on the fact that the voltage Va of the battery 40 is equal to or higher than the threshold value Vp, the procedure is terminated.

Changes in the battery voltage in relation to control of the electric variable valve timing mechanism 20 as described above will now be described with reference to FIG. 5 in comparison with the prior art.

Figure 5:
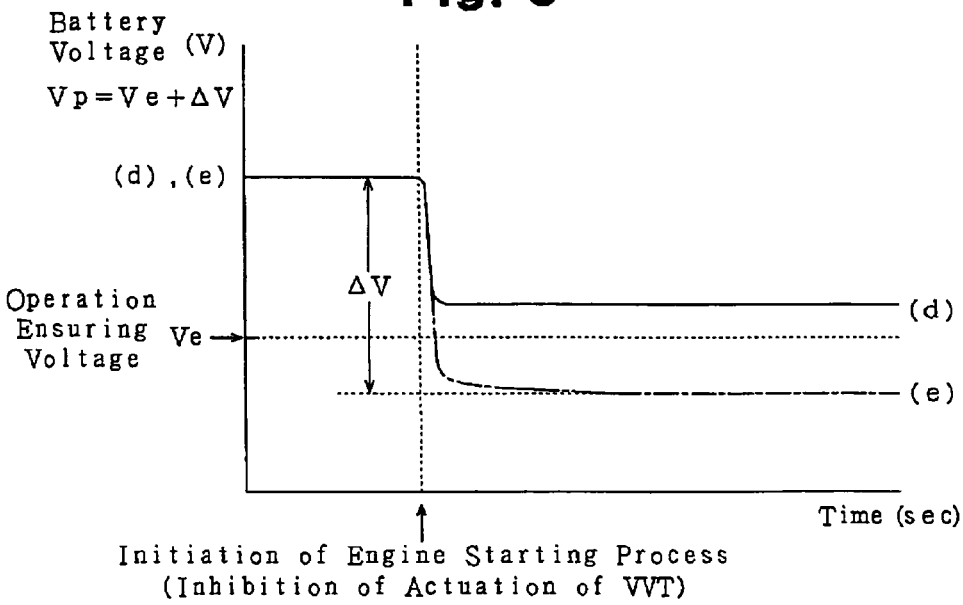
FIG. 5 is a time chart showing changes in battery voltage over time.
Figure 6:
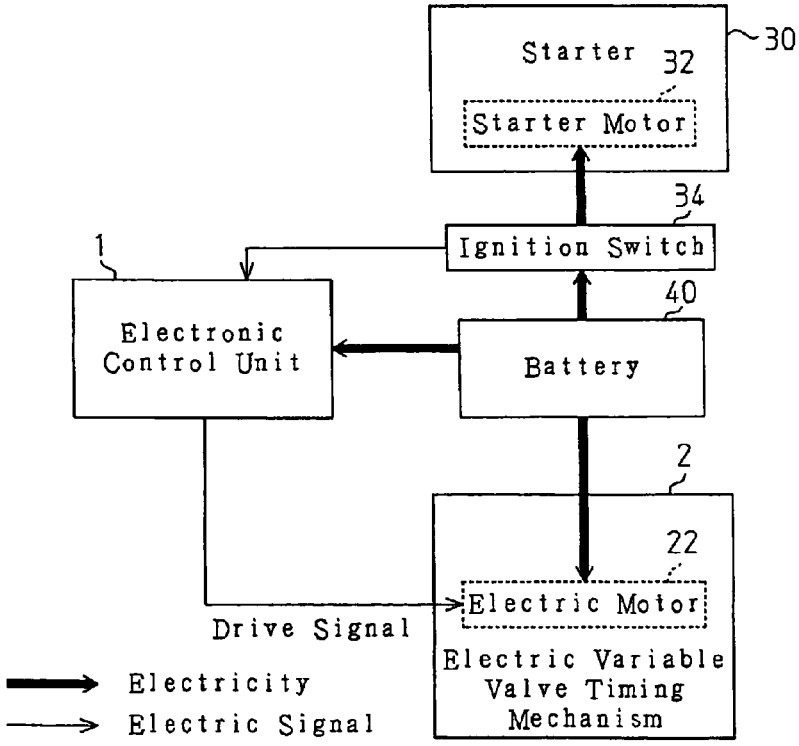
Fig. 6 (Prior Art)
FIG. 6 is a block diagram illustrating an electric configuration of a control apparatus for a prior art electric variable valve actuation mechanism and peripheral devices.

Like FIG. 3, FIG. 5 shows changes in the voltage of the battery 40 over time during the engine starting process. In FIG. 5, solid line (d) and alternate long and short dash line (e) each show changes in the voltage Va of the battery 40 over time in a case where the voltage Va is relatively low before initiating the engine starting process. Like alternate long and short dash line (c) in FIG. 3, alternate long and short dash line (e) in FIG. 5 represents changes in the voltage Va of the battery 40 during the control of the electric variable valve timing mechanism 20 of the prior art. On the other hand, solid line (d) in FIG. 5 represents changes in the voltage Va of the battery 40 during the control of the electric variable valve timing mechanism 20 of the second embodiment.

In this embodiment, when the voltage Va of the battery 40 when initiating the engine starting process is less than the threshold value Vp ($Vp=Ve+\Delta V$), the actuation of the electric variable valve timing mechanism 20 is inhibited in advance. Therefore, as shown in FIG. 5, even if the voltage Va of the battery 40 is lowered due to the engine starting process, the voltage Va of the battery 40 does not fall below the threshold value Ve during the engine starting process.

The control apparatus for an electric variable valve actuation mechanism according to the above illustrated embodiment provides the following advantages.

(1) The actuation of the electric variable valve timing mechanism 20 is inhibited on the condition that the voltage Va of the battery 40 when initiating the engine starting process is less than the threshold value Vp, which is obtained by adding an amount of decrease ΔV of the voltage Va of the battery 40 that is predicted to be caused due to the engine starting process to the voltage Ve that ensures the operation of the electronic control unit 10. Therefore, by stopping the supply of electricity to the electric variable valve timing mechanism 20 before the engine starting process is actually initiated, a great amount of electricity is supplied to devices such as the starter 30 and the electronic control unit 10. Thus, not only the starter 30 is actuated, but also the operation of the electronic control unit 10, which is actuated by electricity supplied from the power source, is ensured. The engine is thus stably started.

The above illustrated embodiments may be modified as shown below.

The controlled subject of the control apparatus for an electric variable valve actuation mechanism according to the present invention is not limited to the electric variable valve timing mechanism 20, which adjusts the opening and closing timing of the intake valve 61. For example, the controlled subject may be an electric variable valve timing mechanism that adjusts the opening and closing timing of both of the intake valve 61 and the exhaust valve 62 of an internal combustion engine, or an electric variable valve lift mechanism that adjusts the lift of the intake valve 61 of an internal combustion engine. In short, the controlled subject may be any type of electric variable valve actuation mechanism as long as it is actuated by electricity form a common power source shared with the starting device of the internal combustion engine and adjusts the actuation of at least one of the intake valve 61 and the exhaust valve 62 of the engine.

The method for limiting the actuation of the electric variable valve timing mechanism 20 is not limited to the methods described above, in which the actuation of the mechanism is inhibited. For example, the actuation may be limited by reducing the electricity supplied to the mechanism when the battery voltage Va falls below the threshold value Ve during the engine starting process. Alternatively, the actuation may be limited by reducing the electricity supplied to the mechanism in advance when the battery voltage Va is less than the threshold value Vp when initiating the engine starting process. In short, the illustrated embodiments may be modified as long as, when the voltage Va of the battery 40 is at such a low level that normal operation of the electronic control unit 10 and the starter 30 cannot be guaranteed, the electricity supplied to the electric variable valve timing mechanism 20 is reduced so that the electricity supplied to the starter 30 and the electronic control unit 10 is increased.

The threshold value is not limited to the voltage values Ve or Vp shown in the illustrated embodiments. For example, the threshold value may be a voltage value Vs (Vs<Ve) that is the minimum required for actuating the starter 30 (starting device). In this case also, the engine starting process can be performed at the very least. Also, it may be configured that, even if the voltage Va of the battery 40 is low, the actuation of the electric variable valve timing mechanism 20 is not inhibited as long as the voltage Va remains above the minimum voltage Vs required for actuating the starter 30. In this case, even if the voltage Va of the battery 40 is relatively low during the engine starting process, the electric variable valve timing mechanism 20 can be actuated to improve the starting performance while actuating the starter 30 in a reliable manner. The threshold value Vp used when initiating the engine starting process may be replaced by a value Vq, which is obtained based on the threshold value Vs (Vq=Vs+ΔV). In short, the threshold value may be changed to any value of voltage that ensures the operation of the starting device based on the electricity consumed by devices such as the electronic control unit 10, the electric variable valve timing mechanism 20, and the starter 30.

The invention claimed is:

1. A control apparatus for an electric variable valve actuation mechanism in an internal combustion engine, wherein the electric variable valve actuation mechanism is actuated by electricity supplied from a common power source shared with a starting device of the engine, to adjust valve timing of at least one of an intake valve and an exhaust valve of the engine, wherein, during a process for starting the engine, the starting device is actuated and the control apparatus controls the electric variable valve actuation mechanism, wherein the control apparatus limits the actuation of the electric variable valve actuation mechanism on the condition that, during the engine starting process, the voltage value of the power source falls below a predetermined threshold value that degrades the operation of the starting device.

2. The control apparatus according to claim 1, wherein the threshold value is a voltage value that is the minimum required for actuating the starting device.

3. The control apparatus according to claim 1, wherein the threshold value is a voltage value that can ensure operation of a device that is actuated by electricity supplied from the power source.

4. The control apparatus according to claim 1, wherein the control apparatus is actuated by electricity supplied from the power source, and the threshold value is a voltage value that can ensure operation of the control apparatus.

5. The control apparatus according to claim 1, wherein the control apparatus inhibits the actuation of the electric variable valve actuation mechanism to limit the actuation of the electric variable valve actuation mechanism.

6. The control apparatus according to claim 1, wherein the control apparatus reduces or stops electricity supplied to the electric variable valve actuation mechanism to limit the actuation of the electric variable valve actuation mechanism.

7. The control apparatus according to claim 6, wherein the electric variable valve actuation mechanism is a variable valve timing mechanism that adjusts valve timing of at least one of the intake valve and the exhaust valve, and wherein, when receiving no electricity from the power source, the variable valve timing mechanism holds valve overlap, during which the intake valve and the exhaust valve are both open, at a shortest valve overlap.

8. A control apparatus for an electric variable valve actuation mechanism in an internal combustion engine, wherein the electric variable valve actuation mechanism is actuated by electricity supplied from a common power source shared with a starting device of the engine, to adjust valve timing of at least one of an intake valve and an exhaust valve of the engine, wherein, during a process for starting the engine, the starting device is actuated and the control apparatus controls the electric variable valve actuation mechanism, wherein the control apparatus limits the actuation of the electric variable valve actuation mechanism on the condition that the voltage value of the power source at the initiation of the engine starting process is below a predetermined threshold value, below which the voltage value is predicted to be lowered to a level that degrades the operation of the starting device during the engine starting process.

9. The control apparatus according to claim 8, wherein the threshold value is obtained by adding an amount of decrease of the voltage of the power source that is predicted to be caused due to the engine starting process to a predetermined voltage value that degrades operation of the starting device.

10. The control apparatus according to claim 9, wherein the predetermined voltage value is a voltage value that is the minimum required for actuating the starting device.

11. The control apparatus according to claim 9, wherein the predetermined voltage value is a voltage value that can ensure operation of a device that is actuated by electricity supplied from the power source.

12. The control apparatus according to claim 9, wherein the control apparatus is actuated by electricity supplied from the power source, and the predetermined voltage value is a voltage value that can ensure operation of the control apparatus.

13. The control apparatus according to claim 8, wherein the control apparatus inhibits the actuation of the electric variable valve actuation mechanism to limit the actuation of the electric variable valve actuation mechanism.

14. The control apparatus according to claim 8, wherein the control apparatus reduces or stops electricity supplied to the electric variable valve actuation mechanism to limit the actuation of the electric variable valve actuation mechanism.

15. The control apparatus according to claim 14, wherein the electric variable valve actuation mechanism is a variable valve timing mechanism that adjusts valve timing of at least one of the intake valve and the exhaust valve, and wherein, when receiving no electricity from the power source, the variable valve timing mechanism holds valve overlap, during which the intake valve and the exhaust valve are both open, at a shortest valve overlap.

* * * * *